United States Patent [19]

Wehling

[11] 4,176,896

[45] Dec. 4, 1979

[54] CONNECTION FOR ELECTRIC LIGHT RAILS

[75] Inventor: Karl Wehling, Lemgo, Fed. Rep. of Germany

[73] Assignee: Staff KG, Lemgo, Fed. Rep. of Germany

[21] Appl. No.: 897,068

[22] Filed: Apr. 17, 1978

[30] Foreign Application Priority Data

Apr. 20, 1977 [DE] Fed. Rep. of Germany ... 7712356[U]

[51] Int. Cl.[2] ..... H01R 11/32; H01R 35/00

[52] U.S. Cl. ..... 339/29 R; 174/88 B; 339/22 R

[58] Field of Search ..... 339/22 R, 22 B, 24, 339/29, 29 R; 174/88 B

[56] References Cited

U.S. PATENT DOCUMENTS

| | | | |
|---|---|---|---|
| 2,879,319 | 3/1959 | Carlson et al. | 339/22 B X |
| 3,450,826 | 6/1969 | Hanes | 174/88 B X |

FOREIGN PATENT DOCUMENTS

| | | | |
|---|---|---|---|
| 800993 | 9/1958 | United Kingdom | 339/28 |
| 907331 | 10/1962 | United Kingdom | 174/88 B |

*Primary Examiner*—E. F. Desmond

*Attorney, Agent, or Firm*—Pollock, Vande Sande & Priddy

[57] ABSTRACT

A connection assembly for joining a pair of electric light rail members, wherein a flexible cable mantle extends between and is attached to a pair of coupling members, with each of the coupling members being attached to a confronting rail member. A plurality of similarly shaped fin members are spaced along the mantle, with each fin member extending substantially radially from the cable mantle and each fin member having an outer contour similar to the outer contour of each of the rail members to provide an optically continuous connection assembly.

13 Claims, 4 Drawing Figures

CONNECTION FOR ELECTRIC LIGHT RAILS

BACKGROUND OF THE INVENTION

The present invention concerns a connection assembly for electric light rails having an internal adapter-receiving channel and electrical conducting strips. The ends of the connection assembly are provided with couplings which electrically engaged the ends of the light rails, with flexible electrical connecting wires enclosed within a mantle extending through the connection assembly and into the couplings.

In conventional connection assemblies of the type suggested in (DT-OS 24 48 041), the mantle and the electrical connecting wires which between the two couplings are contained within a folding bellows-like assembly which has an outer contour that corresponds generally to the contour of the adjacent couplings. The folding bellows merely forms a cover for the mantle, while serving to optically continue the outer contour of the adjacent couplings. As a result, the connection of the wires and the mantle to the couplings is exactly the same as the connection for open cable assemblies. To relieve the tension between the cable and attached couplings, the ends of the cable are secured to the couplings by means of clamps, as demanded by the present VDE regulations. This type assembly of electrical wires and couplings is made significantly more difficult by the provision of the folding bellows surrounding the mantle and cables.

A further disadvantage of conventional connection assemblies is that the folding bellows tends to prevent a proper positioning of the light rails when rotated relative to one another, because the folding bellows becomes irregularly distorted when submitted to torsion. Thus, in certain cases, when the assembly of adjacent light rails requires rotary misalignment, the folding bellows has to be eliminated and the wires left uncovered as a result thereof.

OBJECTS AND SUMMARY OF THE PRESENT INVENTION

A purpose of the present invention is to provide a connection assembly of the type discussed herebefore which forms an optical continuation of the contours of the adjacent light rails, while at the same time permitting rotary misalignment of the rails and elimination of complicated clamping means as required in the conventional prior art.

In order to achieve this purpose, the ends of the cable mantle which extend within the couplings are provided with flanges which are held behind abutments in the couplings, and the cable mantle is provided with fins having an outer contour which substantially corresponds to the contour of the couplings and/or that of the light rails. The fins are positioned such that when the cable mantle is straight, the fins are parallel to each other and substantially perpendicular to the longitudinal axis of the cable mantle.

With the preferred embodiment of the present invention, a separate and complicated strain relieving assembly is not required because the connection assembly itself is constructed to function simultaneously as a strain relieving means. It is sufficient to insert the ends of the cable mantle into the locking means in the flange on one face of the coupling. The contour of the adjacent light rail and input are optically continued through the connection assembly by means of the attached fins. It is thereby possible to arrange adjacent light rails at any desired angle in a given plane and also twisted relative to each other with the connection assembly extending therebetween.

In a prefered embodiment, the fins have a substantially rectangular outer form, which corresponds to the rectangular outer form of the light rail and of the couplings.

In a further embodiment, the fins are formed with pairs of sides of differing length, with the shorter sides being outwardly curved. This embodiment can be employed for light rails which have outwardly curved flanks.

It has furthermore proved to be advantageous to form a collar on the cable mantle which is positionable between the flange and the face of the coupling, which has flat parallel shoulders at right angles to the cable axis, seated on the flanks of a slot in the coupling.

In a prefered embodiment of the invention, a brace having a slot with parallel extending can be inserted at right-angles to the axis of the cable mantle With this embodiment the assembly is especially easy. The mantle collar is pushed into the coupling housing after which the brace is inserted at right-angles to the mantle and the coupling is closed with a cover plate.

In a prefered embodiment, the cover plate for the coupling is a substantially flat plate formed with two outwardly curved side walls. The different shapes of the cover plate forms make it possible to match the couplings to the various forms of the light rails while keeping to the same technical construction.

BRIEF DESCRIPTION OF THE DRAWINGS

In the following, a prefered embodiment of the invention will be described in detail with the aid of the accompanying drawings, wherein.

Showing in.

DETAILED DESCRIPTION OF THE PRESENT INVENTION

Figures 1, 2, 3, 4:
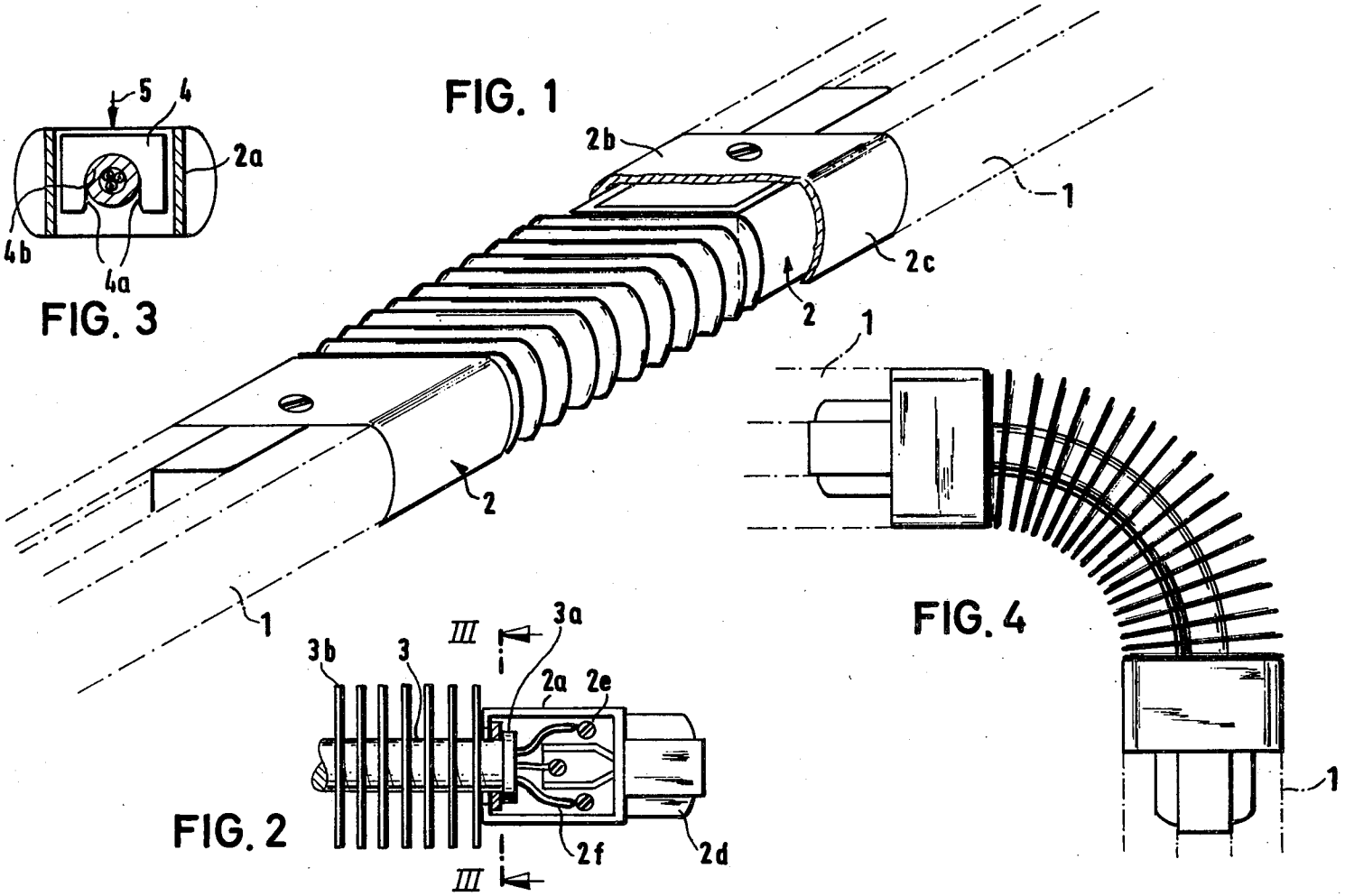
FIG. 1 shows a perspective view of the connection assembly of the present invention with the adjacent light rails attached to opposite sides of the connection assembly.
FIG. 2 shows a portion of the connection assembly and one of the couplings, the cover plate of which has been removed.
FIG. 3 shows a section along the plane III—III in FIG. 2.
FIG. 4 shows a plan view of the connection assembly bent through an angle of 90°.

Two light rails 1 formed with outwardly curved flanks are indicated in dot-dash lines in FIGS. 1 and 4. Rail sections 1 are joined together via a connection assembly formed according to the present invention. The connection assembly has a pair of couplings 2 mounted on either end, wherein couplings 52 are generally known and are formed as a substantially rectangular housing 2*a*. Each housing can be closed by a cover plate 2*b* and each cover plate 2*b* has a flat top surface and two outwardly curved side wall portions 2*c* which form a continuation of the contour of the adjacent light rails.

The couplings 2 are fitted with electrical contacts 2*d* which are not shown in detail and which are connected via attached screws 2*e* with electrical wires 2*f*. The electrical wires 2*f* pass through a cable mantle 3 which is provided with a collar 3*a* at each end. The central zone of the cable mantle 3 is occupied by spaced fins 3*b* which are vulcanised to the mantle 3. The outline of the fins 3*b* corresponds to the outline of the adjacent cover plate 2*b*, 2*c* and also to that of the light rails 1. Furthermore, when mantle 3 assumes a generally straight line shape, the fins 3*b* extend substantially parallel to one another and each fin 3*b* also extends substantially perpendicular to a longitudinal axis through mantle 3.

For assembly, the collar 3*a* can be inserted into a correspondingly large hole in the end surface of the housing 2*a* of the coupling 2. The wires 2*f* are then connected couplings 2 via contact screws 2*e*. The securing of the cable mantle and collar then takes place in that a brace 4 is inserted in the direction of the arrow 5 between the collar 3*a* and the end wall of the housing 2*a* facing the fins. The brace 4 is generally bridge-shaped and includes a pair of flank portions 4*a* which extend substantially parallel to one another, with the flank portions 4*a* being separated to form a slot portion 4*b* therebetween. Upon assembly, slot portion 4*b* of brace 4 abuts mantle 3 as shown in FIG. 3. As a result, the position of collar 3*a* is fixed and the electrical connections are effectively relieved of load.

I claim:

1. Connection for electrical light rails which have an internal adapter-receiving channel and electrical conducting strips, the ends of the connection being provided with couplings which plug onto the ends of the light rails and between which are flexible electrical connecting wires enclosed within a mantel which extends into the couplings, characterised in that the ends of the cable mantle within the couplings are provided with collars which are held behind abutments in the couplings, and that the cable mantle is provided with fins the outer contour of which corresponds to the outer contour of the couplings and/or that of the light rails, and which, when the cable mantle is straight, are parallel to each other and perpendicular to the longitudinal axis of the cable mantle.

2. Connection according to claim 1, characterised in that the fins are substantially rectangular in outline.

3. Connection according to claim 1, wherein a pair of opposite edge portions of each of the fins are outwardly curved.

4. Connection according claim 1, characterised in that a part is provided on the mantle between the collar and the end wall of the coupling, which has flat parallel surfaces at right-angles to the axis of the cable and which is seated on the flanks of a slot in the coupling.

5. Connection according claim 1, characterised in that the flanks of the slot are parallel to each other and that they are provided on a brace which can be inserted at right-angles to the axis of the mantle.

6. Connection according claim 1, characterised in that the cover plate for the coupling is a substantially flat plate with two outwardly curved side walls.

7. A connection assembly for joining a pair of electric light rails of the type including internal adaptor-receiving channel and electrical conducting strips, and comprising:

a pair of detachable coupling members, each engaging an end portion of a respective electric rail;

a flexible mantle assembly having at least one electrical connecting wire extending therethrough, said mantle extending between said pair of coupling members;

attachment means for fixedly positioning opposite end portions of the mantle relative to each of said coupling members to prevent the electrical connecting wire from being stressed in tension therebetween;

fin means extending substantially outwardly from said mantle assembly for providing an outer contour along said connection assembly which is substantially similar in shape to an outer contour of each of said adjoining rails.

8. A connection assembly according to claim 7, wherein a plurality of separate electrical connecting wires each extend through said flexible mantle assembly.

9. A connection assembly according to claim 7, wherein said attachment means comprises an outwardly extending collar-like member attached to opposite end portions of said mantle, said attachment means further comprises a slot-like opening formed in an end portion of each coupling member, with a portion of mantle extending through each opening and each of said collar-like members positionable within a respective coupling member.

10. A connection assembly according to claim 7, wherein said attachment means further comprises a brace member including a pair of spaced, parallel-extending flanks with a slot-like opening positioned therebetween, said brace being positionable about said mantle between an end wall of each of said coupling members and its respective collar member to prevent accidental separation of said mantle from said coupling members.

11. A connection assembly according to claim 7, wherein said fin means comprises a plurality of substantially rectangularly-shaped fin members spaced along said mantle assembly, with each of said fin members being of substantially similar shape.

12. A connection assembly according to claim 7, wherein said fin means comprises a plurality of separate fin members, each fin member further includes a pair of oppositely disposed curved edge surfaces extending away from one another and similar in shape to the shape of the edge surfaces formed on each of said adjoining rails.

13. A connection assembly according to claim 7, wherein said coupling member includes a substantially box-shaped support member formed with a base portion and a plurality of attached side wall portions, each of said coupling members further includes a cover plate which engages each of said box-shaped support members to form closed chambers;

and each of said cover plates further includes a pair of curved, side wall portions of a shape similar to the shape of adjoining side wall portions of said rails.

* * * * *